US009248555B2

(12) United States Patent
Ford, Jr.

(10) Patent No.: US 9,248,555 B2
(45) Date of Patent: Feb. 2, 2016

(54) LOCKING V HINGE TOOL DEVICE

(71) Applicant: Vernon James Ford, Jr., Palm Bay, FL (US)

(72) Inventor: Vernon James Ford, Jr., Palm Bay, FL (US)

( * ) Notice: Subject to any disclaimer, the term of this patent is extended or adjusted under 35 U.S.C. 154(b) by 263 days.

(21) Appl. No.: 14/016,298

(22) Filed: Sep. 3, 2013

(65) Prior Publication Data

US 2015/0059535 A1 Mar. 5, 2015

(51) Int. Cl.

| | |
|---|---|
| ***B25B 13/32*** | (2006.01) |
| ***B25B 13/38*** | (2006.01) |
| ***B25B 5/00*** | (2006.01) |
| ***B25B 5/08*** | (2006.01) |
| ***B25B 7/12*** | (2006.01) |
| ***B25B 7/18*** | (2006.01) |

(52) U.S. Cl.

CPC ..... *B25B 13/32* (2013.01); *B25B 5/006* (2013.01); *B25B 5/08* (2013.01); *B25B 7/123* (2013.01); *B25B 7/18* (2013.01); *B25B 13/38* (2013.01)

(58) Field of Classification Search

CPC ..... B25B 13/32; B25B 13/38; B25B 7/18; B25B 7/123; B25B 5/08; B25B 5/006

USPC ..... 81/112, 116, 90.1, 90.2

See application file for complete search history.

(56) References Cited

U.S. PATENT DOCUMENTS

| | | | | | |
|---|---|---|---|---|---|
| 181,699 | A * | 8/1876 | McDonough | ..... | 81/112 |
| 311,892 | A * | 2/1885 | Gibbons | ..... | 81/128 |
| 626,381 | A * | 6/1899 | Humiston | ..... | 81/112 |
| 640,308 | A * | 1/1900 | Koch | ..... | 81/112 |
| 1,499,186 | A * | 6/1924 | Murphy | ..... | 81/112 |
| 2,569,551 | A * | 10/1951 | Bradley | ..... | 81/112 |
| 2,814,226 | A * | 11/1957 | Lojczyc | ..... | 81/112 |
| 6,205,892 | B1 * | 3/2001 | Davidson | ..... | 81/128 |

* cited by examiner

*Primary Examiner* — Hadi Shakeri

(57) ABSTRACT

The locking V hinge tool of this invention comprises three or more pieces. The first two pieces are fundamentally identical and reversed, comprised of three main sections in optional order of, a jaw end, a common axle, and a arc-like cam, assembled together and rotate through the common axle, allowing the jaw ends to open and close. A third pin holding piece holds a pin that rides in and moves, the criss-crossing arc-like slots in the other pieces, at or near an angle aimed at the corners of a diamond like opening where the two arc-like slots intersect. Any external force exerted on the jaw ends, attempt to force the pin in the arc-like slots to rise to an upright position but are blocked by the walls.

15 Claims, 5 Drawing Sheets

LOCKING V HINGE TOOL DEVICE

This invention relates to a locking device and, more particularly, to a self-locking tool that will lock an object held therein.

BACKGROUND OF THE INVENTION

It is known to use various tools for holding and locking work objects in place. There are other tools which utilize connecting parts that are rotatable upon a common axis. Some of these tools are disclosed in U.S. Pat. Nos. 682,701; 644,825; 1,026,270; 1,401,931; 1,450,875; 1,717,726; 2,370,308; 2,574,909; 2,787,925; 3,126,775; 3,257,878; and 4,633,558; 5,005,450; 6,662,690 In U.S. Pat. No. 682,701 (Howland) a locking pliers is disclosed having a plurality of pieces movable along a multitude of pivot points. There is a central pivot A having 5 or 6 separate pieces movable thereabout. When the pliers of Howland is in the locked position an object is held between jaws B and C which are in turn pivotally connected to D, H, J and r. Howland's device is relatively complex in usage and construction. Both handles of Howland's also must be held at all times during use in order to maintain an object locked in position. Also, Howland requires a high friction surface to function properly.

U.S. Pat. No. 644,825 (Jensen) discloses a wrench having handle means that can be locked in place by a spring means n. The spring is positioned on the bottom portion of one of the handles. When pin g of Jensen is pressed out of the socket h, it is slid into the socket g and spring n holds it in place. The holding device of Jensen is again relatively complex in construction and would be relatively expensive to manufacture.

U.S. Pat. No. 1,026,270 (Leonard) discloses a pipe wrench with a holding device to permit the wrench to be applied to a pipe or rod. A spring 15 in Leonard engages the handle 13 and its opposite end is secured to the shank of the wrench. The spring 15 locks the handle in position between the jaws 5 and 6. As in many locking tools, Leonard relies upon a spring means to provide the locking mechanism in his device.

In Whelan U.S. Pat. No. 1,401,931 an adjustable pipe wrench is disclosed which uses a quadrant attachment element together with two jaws to hold an object in position. The wrench of Whelan holds pipes or the like of various diameters with a three point grip, each of the three elements having a gripping surface. McGill U.S. Pat. No. 1,717,726 and Burrows U.S. Pat. No. 2,574,909 each disclose wrenches having holding means to tightly hold items. Each discloses a wrench having several parts and several focal points for each part. Included in both patents are adjusting means to tighten or loosen objects held within the jaw assemblies of the respective wrenches.

In Teselsky U.S. Pat. No. 1,450,875 a pliers is disclosed having a third jaw section that will co-act with the other two jaws of the pliers to prevent the article gripped from slipping. Handle means 5 and 6 of Teselsky each terminate with a jaw section, these jaw sections have a shank mounted around the exterior portion of one of the jaws. This shank acts as a third jaw which co acts in a gripping operation.

Hanson U.S. Pat. No. 2,370,308 has a circular cam that can wedge a nut and hold it in position with handles grasped or under moderate pressure.

Buchanon, U.S. Pat. No. 2,787,925, has used rotational sliding cams for movement of socket like wedges, Ramge, U.S. Pat. No. 3,126,775. Uses a Rotational wedge for temporary hold using cams.

Anderson, U.S. Pat. No. 3,257,878 a crescent wrench with rack means of locking a jaw with axle motion and with means to further adjust the jaw, not necessarily in a locking manor.

Spaulding, U.S. Pat. No. 4,633,558, discloses a tool for applying a spring clamp to an object. Spaulding utilizes a cam which is carried by one of the jaws and a pair of side plates pivotally supported by the other of said jaws having cam control tracks therein for affecting and controlling radial movement of said cam to complete closure of said clamp. There are means on a jaw for controlling rotation of the cam and the cam is engaged to a hook portion to the spring clamp to effect closure.

Ford U.S. Pat. No. 5,005,450 Self-locking tool locks both the pin and radial around an axle point only and locks by angle of pins in cams included in the handle pieces. Curved slots being expensive to produce.

Ford U.S. Pat. No. 5,033,338 Self-locking Device locks both the pin and radials around an axle point only in a pliers or socket like manor, where part of the locking mechanism is one of the handles which in turn is used as leveraged pressure to move the jaw section, and in that way angle and lock the pin in position using all three plates. The movement or rotation of the plate is from an external motion not the force of the jaw.

In Ploeger U.S. Pat. No. 6,662,690 Discloses a Pliers for clamping a hose or tube which moves a pin only to a radial angle, using a tan genial slot wall to hold it temporarily. It allows for a very limited movement around a central axle with limited stability.

All of the above prior art devices are relatively complex in structure, most require springs for a locking effect and several are complicated to use. There is a need for a relatively simply-constructed tool that will lock an object in position without the need for springs or other such means.

SUMMARY OF THE INVENTION

It is therefore an object of this invention to provide a locking tool devoid of the above-noted disadvantages.

Another object of this invention is to provide a locking tool having two handle means wherein only one needs to be held after pressure has effected a locking of the object.

Another still further object of this invention is to provide a tool having a cam leverage to align and control the tilt the pin thereby locking the tool.

Yet another object of this invention is to effectively align and control the tilt of the locking pin so that a variety of thicknesses and cam slopes can be used while still actively holding the pin in a jammed locked position as opposed to a frictional hold.

A still further object of this invention is to provide a locking tool that can be used to easily lock and release an object held therein, also in both an open or closed direction.

Yet another object of this invention is to provide a locking tool that is relatively simple in construction and relatively inexpensive to use.

Still another object of this invention is to provide a locking tool that is relatively easy to use yet effective in holding an object securely.

Still yet a further object of this invention is to provide a tool that has means to lock in two directions; rotationally counter-clockwise, and clockwise.

Yet still a further object of this invention is to provide a locking tool wherein once the lock is effected, handle pressure can be released without affecting the lock.

Still yet a further object of this invention is to allow a wide variety of handle and jaw attachments and systems to be used with this toothless ratcheting system.

Yet another object of this invention is to use the jaw motion and locking to additionally control additional jaw pieces and associate their function to the primary jaw motion and locking.

Still a further object of this invention is to allow handle and jaw attachments to affect locking pin angle and to form axis points of the axle and cam pin to rotate the plates for further leveraging and control.

Still another further object of this invention is to allow that an over center linkage may be added to one or more of the jaw section by extending the handle section of the linkage beyond the handle to jaw connection, so that the primary leveraging handle of such linkage can be rotated in both rotational directions as in a toggle, to effectively open and close jaw or other linkage, in such a manor to effect an over center lock or to allow squeezing on the jaw section, with or without having to place fingers in between the handles.

Still another further object of this invention is to allow that an over center linkage may be added to one or more of the jaw section for any and all locking pliers or regular pliers, so that the primary leveraging handle of such linkage can be rotated in both rotational directions as in a toggle by extending the handle section of the linkage beyond the handle to jaw connection, to effectively open and close jaw or other linkage, in such a manor to effect an over center lock or to allow squeezing on the jaw section, with or without having to place fingers in between the handles, and thus eliminating or augmenting a handle opening spring.

Yet another object of this invention is to allow movement of the jaws by a pin in the slots and control the tilt of that pin to allow locking and then further increase or decrease in that tilt to further move the jaws by means of the pin effecting the cam slots.

Still another object of this invention is a pliers or over center leveraged locking pliers like tool wherein the release of locking tension can be formed in the upper or lower end, opposite the locking handle of a toggle like handle on the outside and extended upward or downward section of the handle, so that push down on this extension, towards the jaw or body of the tool would have higher leverage to be able to move the handle linkage over center locking and release the lock, so that it is easier to get at and does not have fingers inside the handle.

Still a further object of this invention is to have a tool that can be applied and locked on a V like edges of but not limited to, bars, rails, cam slots at any point on the V edge corresponding to the position and movement of the locking pin.

Still another object of this invention is a pliers or over center locking pliers like tool wherein there exists an adjustable distance on the over center handle or toggle handle to the linkage to the body of the tool, such that a wedge, screw, cam or any control means to increase or decrease the distance in the linkage, allowing for segmented or variable leveraging advantage with or without requiring re-adjustment of pressure screw or slide piece or any other means for pressure distance, allowing for large squeeze and grasping use or tight extreme high leverage pressure.

Still a further object of this invention is to act as a locking hinge like device, to hold and lock in position relative to the position of the third plate locking pin in the cam slots, so that any external pressure or shock to the jaws will have no effect on jaw movement.

These and other objects are accomplished by the present invention by providing a locking tool comprising in combination two handle pieces and a third or remaining piece. Two handle pieces have a jaw, arc-like slots and an axle point. They are reversed so the arc-like slots oppose each other and connect together at the axle point. A Third piece has a hole for a pin to go through. This pin rides inside the arc-like slots of the two handle pieces. As it rides up/down in the slots, it opens/closes the jaw sections of the two handle pieces.

The arc-like slots in the first handle piece and second handle piece spiral in the opposite directions which is critical to the present invention. When the first and second handle pieces are stacked and assembled with the third remaining piece, the spiraling slots are of approximately the same size, spiral in the opposite direction, have substantially the same arc-radius and are substantially identical in configuration. They must be aligned in at least a portion with the opening of the hole in the third piece so that a locking pin can fit in an opening. The locking pin extends through the slots in the two pieces and through this diamond like shaped opening.

When the third piece and it's alignment of the pin in it's hole, are slid up/down the length of the handles, the pin pushes on the slot walls causing the two handle pieces to open or close. When an object is placed in the jaw section, any motion applied to the jaws cause the pin in the slot to attempt to point in one of the four corners formed by the overlapping slots into a diamond like opening and to attempt to become aligned to the slot walls. The angled slot third piece's pin having caps on both ends, and already aligned by the third piece hole, misaligns slightly more in the arc slots, held in place by the top and bottom edges of the respective cam slots on the two handle pieces, as the pin is forced to slanted further towards the diamond like corners, and not in the direction needed with the opening and closing directional curvature direction of the arc-like slot in both the first and second pieces. The curvature of the one piece's (opposite to the direction of the pin tilt), arc-like slot wall at each level or layer of the pin position, blocks pin movement down or up the arc-like slot of the other piece's arc-like slot, and thus jaws are held in place.

Release involves moving the third piece and it's pin so that the pin is realigned against the cam slot walls in a new position along the arc-like slots. An additional pin or guides maybe used to keep the diagonal of the pin in the proper direction. Sliding pieces may be inserted into the cam slots for the locking pins to fit through so that surface area of pins as the affect the cam slots can be increased.

All of the slots in the three pieces should have a width dimension slightly more than the diameter of the pin to permit it to be freely movable therein. In a preferred embodiment of the invention one slot is used in each of the three pieces, however, more than one slot in each can function equally well. While there can be one slot or a plurality of slots in each of the three pieces, there must be at least one slot in each piece and at least one axle pin and at least one locking pin. Multiple layers of plates can be laminated and used to both support and position the locking pin. External forces can be applied to the pin to control it's locking angle and for leverage purposes.

When an object is to be grasped in the jaws of this tool, the third piece needs to be slid up or down to cause the first and second piece to move together. The axle points on each one of these pieces can then be separated by handles or linkage to affect a rotation around the third piece's pin causing the jaws to tighten. Off center cam or over centered linkage and leverage systems can be used either in stand alone vise like action or rotational holding and or locking.

Additional jaws may be placed on either side of the axle points of the first and second pieces. The third piece can be a strip guided for movement on one of the two handle pieces with teeth like edge that can be used for ratchet type movement. The angle of the hole or pin of the third piece may be wedged externally or otherwise to increase or decease desired affect.

An additional fifth piece being a copy of either one of the handle pieces but without the connection to the main axle piece, and with connection of this piece at or near the jaw section of the first or second handle piece having the arc-like slots in the same direction. the corresponding same arc-like slot in the same direction piece would have it jaw section removed, and the jaw section of this fifth piece would be used instead. movement of an object in the jaws would rotate this fifth piece around its own axle up by the jaw section and thus rotating the curve arc-like slot against the third piece pin holding said pin in a rotational or horizontal direction, preventing movement of the jaws in reverse.

Additional linkage can be added to allow that an over center linkage may be added to one or more of the jaw section of this tool or to any pliers or locking pliers type tool, so that the primary leveraging handle of such linkage can be rotated in both rotational directions as in a toggle, to effectively open and close jaw or other linkage, in such a manor to effect an over center lock or to allow squeezing on the jaw section, with or without having to place fingers in between the handles. The handle section of the linkage is extended over the jaw connection thus eliminating or augmenting the customary spring.

Release of locking tension can occur in the upper or lower end, opposite the locking handle of a toggle like handle on the outside and extended upward or downward section of the handle, so that pushing down on this extension, towards the jaw or body of the tool, against the over centered connection, would have higher leverage to be able to move the handle linkage over center locking and release the lock. In normal toggle motion it would be held in place by a spring or bump and act as a return of the handle in a toggle see-saw manor.

An adjustable distance on the over center handle or toggle handle to the linkage to the body of the tool, such that a wedge, screw, cam or any control means to increase or decrease the distance in the linkage, allowing for segmented or variable leveraging advantage with or without requiring re-adjustment of pressure screw or slide piece or any other means for pressure distance, allowing for large squeeze and grasping use or tight extreme high leverage pressure.

The tool of this invention can be used in hand tools such as pliers or wrenches or in vices, other gripping devices, hinging devices with position locking and as a differential clutching, locking device, and positioning to the relative speeds of rotation of the plates.

BRIEF DESCRIPTION OF THE DRAWING

FIG. 2 C is top piece as a reflection of piece 1.

DETAILED DESCRIPTION OF THE DRAWINGS AND PREFERRED EMBODIMENTS

Figure 1:
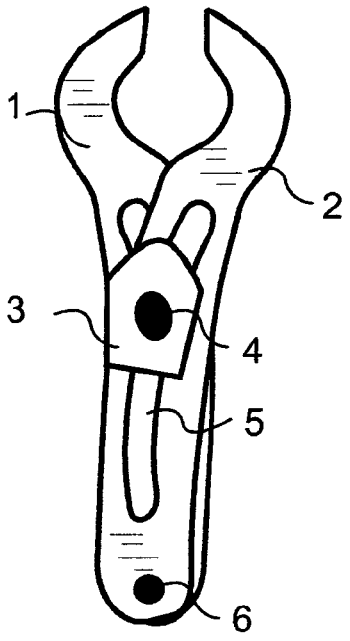
FIG. 1 is a plan top view of the assembled locking tool of this invention.

In FIG. 1 the locking tool of this invention is illustrated in its assembled condition. The tool comprises in this embodiment three main component pieces, a first handle piece 1, a second handle piece 2 and a third piece 3.

Figure 2A:
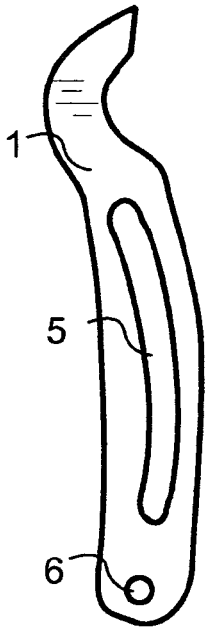
FIG. 2 A is a plan top view of the disassembled locking tool of this invention, bottom piece, FIG. 2 B is a plan top view of the pin holding piece of the disassembled locking tool of this invention.
Figure 2B:
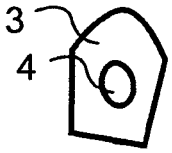
Figure 2C:
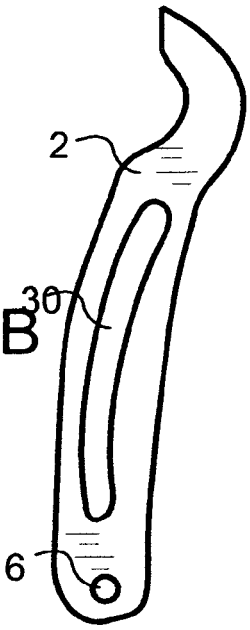

As shown in FIG. 2 A, The first handle piece 1 has in its upper portion a jaw section and below the jaw section and arc-like slot section 5, an axle aperture. By "below" is meant when piece is held vertically, at the top portion would be jaw and "below" would be located axle aperture. Below the jaw section in first handle piece 1 is a first arc-like slot 5 through which a diagonal pin 9 will extend and travel. Diagonal pin 9 will also travel in and extend through a arc-like slot 30 in second handle piece 2.

In FIG. 2 B a pin holder piece is shown, holding the connecting pin and can ride in cam slots 5 and 30 respectively.

As shown in FIG. 2 C, Piece 2 is identical and reversed of FIG. 2 A.

Figure 3:
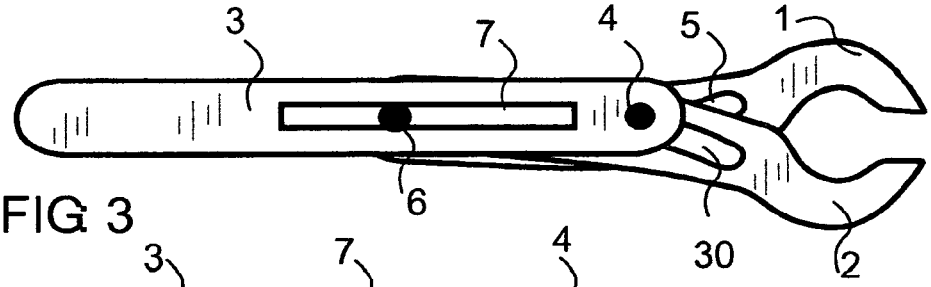
FIG. 3 is a plan top view of the assembled locking tool of this invention with a wrench like handle.

FIG. 3 is a plain top view of the assembled locking tool of this invention in a half way opened position. The third piece is extended and a cam slot 7 holds the common axle 6 of the first and second piece. As piece 3 slide up/down the diagonal pin 9 in slots 5 and 30 to open/close jaws.

Figure 4A:
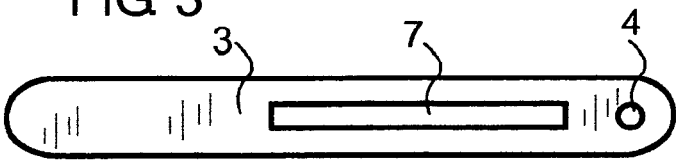
FIG. 4 A is a plan top view of the disassembled locking tool of this invention with a wrench like handle as the pin holding piece, FIG. 4 B is a plan top view of the disassembled locking tool of this invention as the bottom piece FIG. 4 C a plan top view of the disassembled locking tool of this invention as the top piece.
Figure 4B:
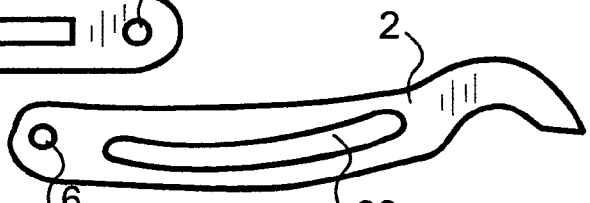
Figure 4C:
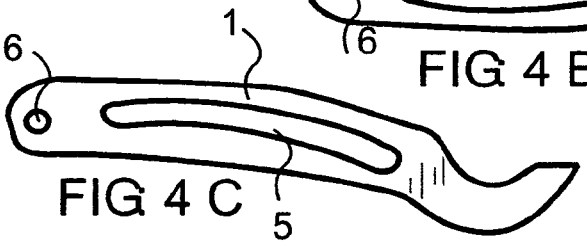

FIG. 4 A shows piece 3 with elongated axle slot 36 and an inclined pin holder hole 4.

FIG. 4B shows piece 2 with it's axle hole for axle pin 6 and cam slot 30 and jaw section 2

FIG. 4 C shows piece which is identical but reversed of FIG. 4 B.

Figure 5:
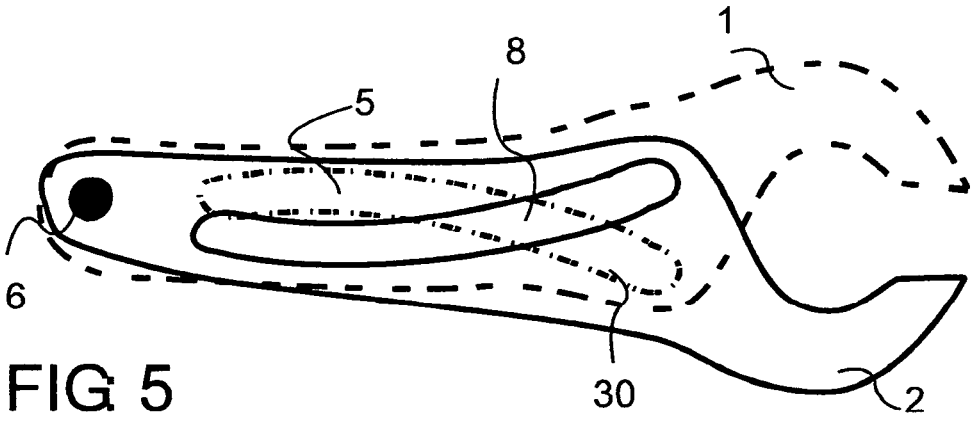
FIG. 5 is a plan top view of the partial assembled locking tool of this invention with one piece showing a diamond like opening where the cam slots intersect.

FIG. 5 is a plain top view of the partial assembled locking tool of this invention in a half way opened position. Piece 1 is see through and piece 2 is a solid line drawing. Diamond like opening 8 is illustrated where the cam slots of the first 1 and second 2 plates intersect.

Figure 6:
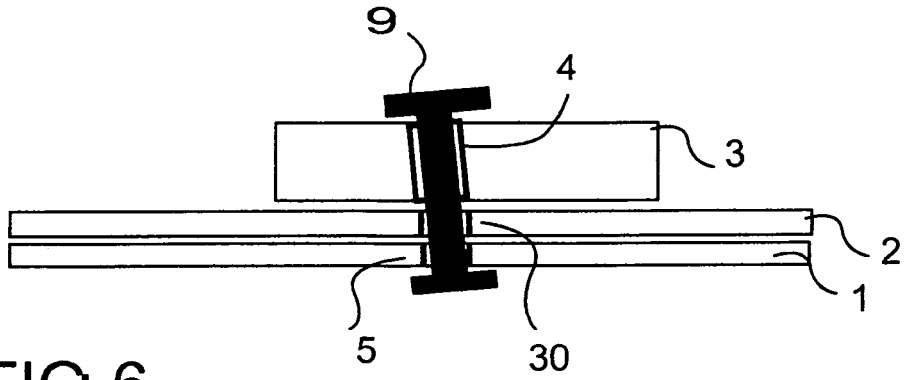
FIG. 6 is a sliced side view of the assembled locking tool of this invention showing one example of stacking of pieces

FIG. 6 is a side view showing stacking of pieces 1, 2, and 3, and diagonal pin 9 in piece 3 and in the slots 5 and 30 of pieces 1 and 2.

Figure 7:
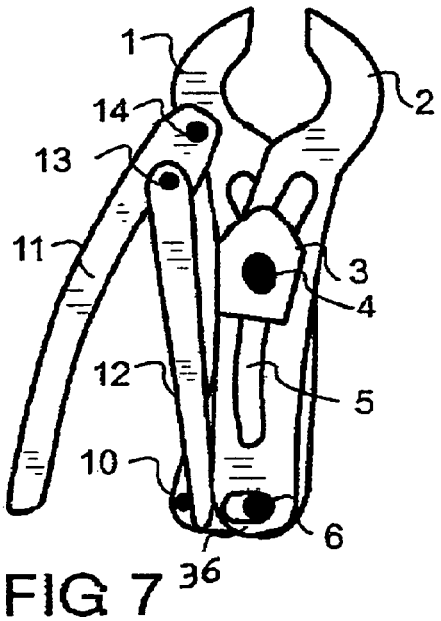
FIG. 7 is a plan top view of the assembled locking tool of this invention with a fourth handle piece and connection to affect rotation of the axle around the cam pin.

FIG. 7 is a top view showing the assembled locking tool of this invention in a half way opened position. Piece 1 has been extended by axle 6 to include a connection guiding pin 10. It also now has a hole near the jaw for connection at axle pin 6 to fourth handle piece 11. Piece 2 has an extended axle slot 36 to rotate piece 2 around diagonal pin 9 to move the jaw section of piece 2. Fourth handle 11 in addition to being mounted to the jaw section of plate 1 at hole 14, also has a hole for connection piece 12. Piece 12 connects to fourth handle 11 at hole 13 and wedges down between lower piece 2 and guiding pin 10.

Figure 8:
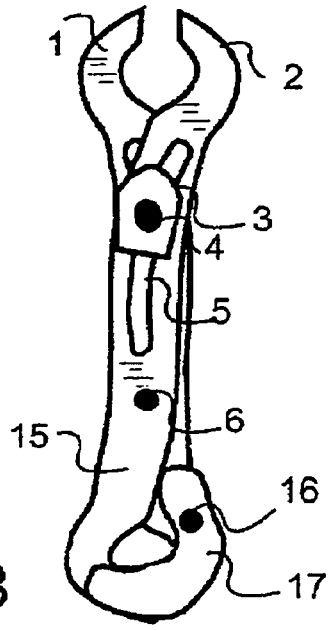
FIG. 8 is a plan top view of the assembled locking tool of this invention with an example of an additional jaw assembly connected to the original first and second piece.

FIG. 8 is a top view showing the assembled locking tool of this invention with the lower ends of piece 1 and piece 2 extended past the common axle 6 forming a secondary set of jaws. An attachment jaw 17 has been attached at axle 16 to piece 1 such that it rotates as piece 2 moves rationally. The movement of jaw 17 in this case is to assist in surrounding any object in the extended jaw sections of piece 1 and piece 2.

Figure 9:
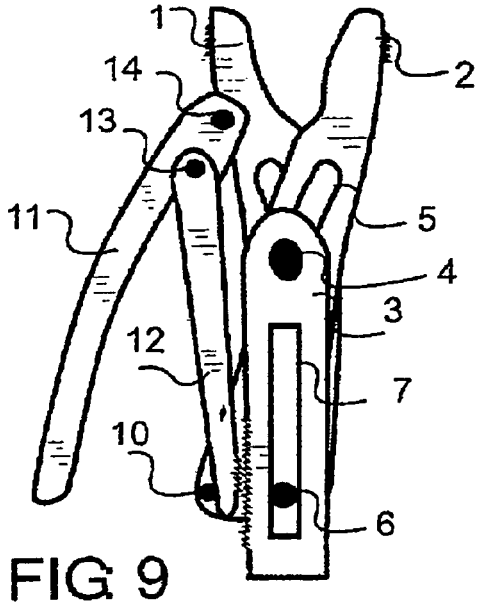
FIG. 9 is a plan top view of the assembled locking tool of this invention with a fourth handle piece and a tooth connection to the pin controlling third piece

FIG. 9 is a top view showing the assembled locking tool of this invention in a half way opened position. Piece 1 has been extended by axle 6 to include a connection guiding pin 10. It also now has a hole near the jaw for connection to fourth handle piece 11. Piece 2 has an extended axle slot to rotate piece 2 around cam diagonal pin 9 to move the jaw section of piece 2. Fourth handle 11 in addition to being mounted to the jaw section of plate 1 at hole 14, also has a hole for connection piece 12. Piece 12 connects to fourth handle 11 at hole 13 and move by means of a tooth connection, onto the extended third piece 3 as shown with a cam slot 7 for common axle 6.

Figure 10:
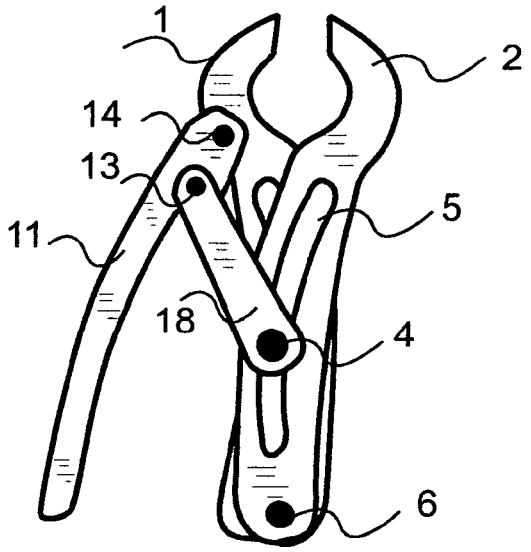
FIG. 10 is a plan top view of the assembled locking tool of this invention with a fourth handle piece and direct connection piece to the third piece

FIG. 10 is a plain top view of the assembled locking tool of this invention with a fourth handle piece and direct connection piece to the third piece. Piece 1 now has a hole near the jaw for connection to fourth handle piece 11. Fourth handle 11 in addition to being mounted to the jaw section of plate 1 at hole 14, also has a hole for connection piece 18. Piece 18 effectively becomes the third piece and connects directly to pin in hole 4 to the cam slots 30 of piece 2 and 5 of piece 1.

Figure 11:
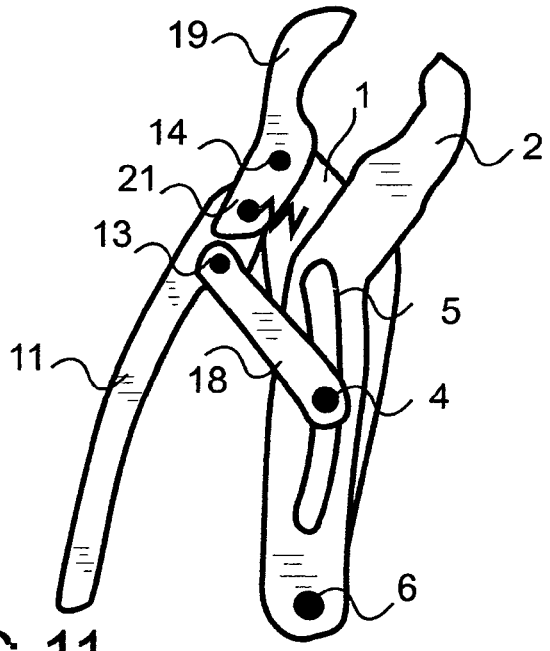
FIG. 11 is a plan top view of the assembled locking tool of this invention with a fourth handle piece and direct connection piece to the third piece while the fourth handle is attached to a leveragable jaw head.

FIG. 11 is a plain top view of the assembled locking tool of this invention with a fourth handle piece and direct connection piece to the third piece while the fourth handle is attached to a leveragable jaw head. Piece 1 now has a hole near the jaw for connection to jaw head piece 19. jaw piece 19 also has a connection for piece 11 at hole 21 Fourth handle 11 in addition to being mounted to the jaw piece 19 at hole 21, also has a hole for connection piece 18. Piece 18 effectively becomes the third piece and connects directly to pin in hole 4 to the cam slots 30 of piece 2 and 5 of piece 1.

Figure 12:
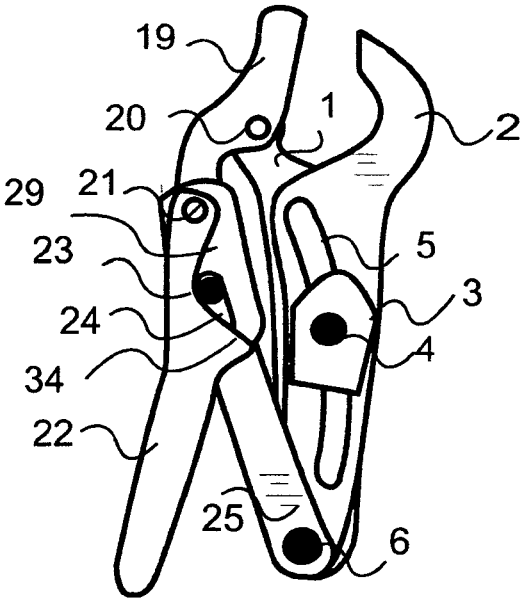
FIG. 12 is a plan top view of the assembled locking tool of this invention with a fourth handle piece and direct connection piece to the common axle, while the fourth handle is attached to a leveragable jaw head and a slide edge located on the forth handle piece to move the connection closer to the jaw addition

FIG. 12 is a plain top view of the assembled locking tool of this invention with a fourth handle piece 22 and direct connection piece 25 to the common axle 6, while the fourth handle 22 is attached to a leveragable jaw head 19 and a slide edge 34 located on the forth handle piece to move the connection 25 closer to the jaw pivot. Piece 29 has an axle hole 21 and a cam slot 24 to move the connection pin 23 by means of edge 34.

Figure 13:
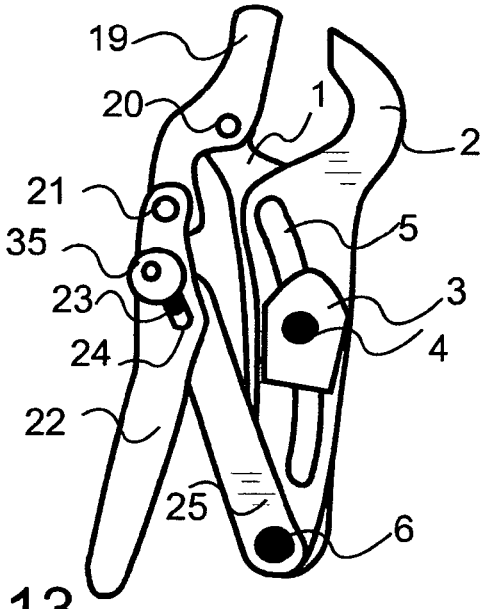
FIG. 13 is a plan top view of the assembled locking tool of this invention with a fourth handle piece and direct connection piece to the common axle, while the fourth handle is attached to a leveragable jaw head and a cam wheel located on the forth handle piece to move the connection closer to the jaw addition
Figure 14:
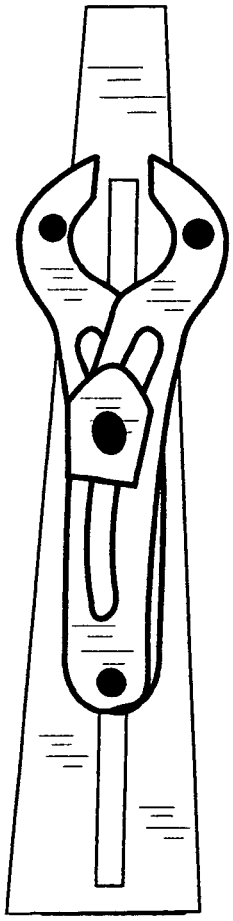
FIG. 14 is a plan top view of the assembled locking tool of this invention placed on a V Edged object with the jaw position attached to an associated position along the V like edge, while the common axle and third piece pin ride a cam down the center.

FIG. 13 is a plain top view of the assembled locking tool of this invention with a fourth handle piece 22 and direct connection piece 25 to the common axle 6, while the fourth handle is attached to a leveragable jaw head 19 and a cam wheel 35 located on the forth handle piece 22 to move the connection 25 at pin 23 closer through a slot 24 on 22 to the jaw addition FIG. 14 is a plain top view of the assembled locking tool of this invention placed on a V Edged object 26 with the jaw position attached 28 to an associated position along the V like edge, while the common axle and third piece pin ride an optional cam down the center cam 27

Figure 15A:
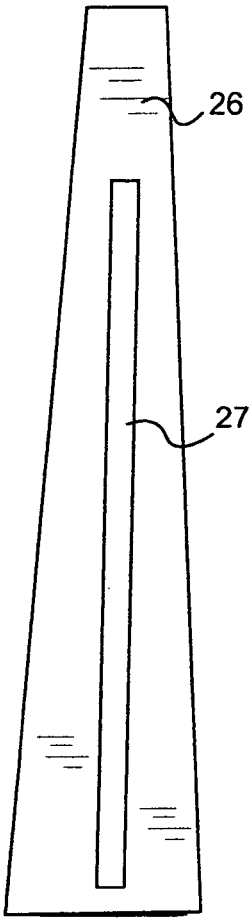
FIG. 15 A is a top view of the partial disassembled locking tool of this invention that was placed on a V edged object. as a top view of the V like edged piece, FIG. 15 B is the assembled locking tool of this invention with holes for attachment.
Figure 15B:
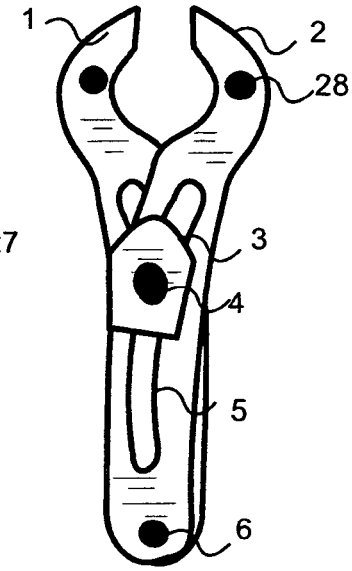

FIG. 15 A shows a top view of the V like edge piece 26 with a center cam like slot 27 that the axle 6 and diagonal pin 9 ride in from FIG. 15 B.

FIG. 15 B shows the assemble locking tool of this invention that would be connected to the edges of V like edge piece 26 by attachment pins 28, and in the center cam or slot 27 by axle 6 and holding diagonal pin 9.

Figure 16:
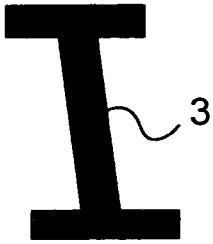
FIG. 16 is a side view of a third piece pin acting as the third piece holding its own angle.

FIG. 16 is a side view of a third piece pin acting as the third piece 3 holding its own angle by means of angled end caps.

What is claimed is:

1. A locking tool comprising:

a first handle piece movably connected to a second handle piece and at least one third piece;

said first handle piece having a jaw portion at one end, an axle aperture at another end and an arc cam slot positioned therebetween;

said second handle piece having a jaw portion at one end, an axle aperture at another end and an arc cam slot positioned therebetween;

an axle pin positioned in the axle aperture of the first handle piece and the axle aperture of the second handle piece;

said jaw portions in said first and second handle pieces having complementary jaw portions that cooperate to form an engaging opening;

said at least one third piece having an inclined holding hole;

a diagonal locking pin positioned in said inclined holing hole and through the arc cam slots of the first and second handle pieces, the diagonal locking pin tilting at an angle corresponding to an inclined angle defined by the inclined holding hole, the overlapping arc cam slots of the first and the second handle pieces forming a diamond shaped aperture defining contact points at four corners;

whereby the curvature of the arc cam slots blocks sliding motions of the tilting diagonal locking pin along the arc cam slots to secure the jaw portions in a desired position by engaging the tilting diagonal locking pin with the contact points, and wherein moving the third piece to align the diagonal locking pin through the diamond shaped aperture releases the engagement of the diagonal locking pin allowing for repositioning of the jaw portions.

2. The locking tool of claim 1, wherein said at least one third piece is positioned sandwiched between said first handle piece and said second piece or outside the same.

3. The locking tool of claim 1, wherein the first, second and said at least one third piece comprise multiple layers.

4. The locking tool of claim 1, wherein said third piece further comprises a washer to enhance the engagement of the diagonal locking pin and for ease of movement.

5. The locking tool of claim 1, further comprising a plurality of linkage for moving said at least one third piece in a leveraged manor.

6. The locking tool of claim 1, further comprising a third handle piece to affect the movement of said at least one third piece.

7. The locking tool of claim 1, further comprising a third handle piece coupled to the first handle piece and a linkage piece, wherein the axle aperture of the second handle piece comprises an extended axle slot and wherein said first handle piece further comprises a guiding pin adjacent said another end of the first handle piece and one end of the linkage piece being coupled to the first handle piece and another end of the linkage piece engaging the guiding pin.

8. The locking tool of claim 1, wherein each of said another end further comprises an additional jaw portion.

9. The locking tool of claim 1, further comprising a third handle piece coupled to the first handle piece, and a linkage piece, wherein said at least one third piece defines an extended piece having the inclined holding hole at one end, an extended cam slot positioned therebelow and extending towards another end and, wherein said first handle piece further comprises a guiding pin adjacent said another end of the first handle piece, one end of the linkage piece being coupled to the first handle piece and another end of the linkage piece engaging the guiding pin, the linkage piece further having an outer toothed surface facing and engaging an outer toothed surface of the extended third piece.

10. The locking tool of claim 1, further comprising a third handle piece coupled to the first handle piece, wherein said at least one third piece defines a linkage piece with one end having the inclined holding hole and with another end coupled to the third handle piece.

11. The locking tool of claim 10, wherein said jaw portion of the first handle piece comprises a leveragable jaw head coupled to the first handle piece and wherein said third handle piece is coupled to the leveragable jaw head.

12. The locking tool of claim 1, further comprising a third handle piece and a linkage piece, the linkage piece having one end accommodating the axle pin and another end coupled to the third handle piece by a connecting pin positioned in a cam slot of a plate piece, wherein said jaw portion of the first handle piece comprises a leveragable jaw head coupled to the first handle piece and wherein said third handle piece is coupled to the leveragable jaw head.

13. The locking tool of claim 1, further comprising a third handle piece and a linkage piece, the linkage piece having one end accommodating the axle pin and another end coupled to the third handle piece by a cam wheel positioned in a cam slot of the third handle piece, wherein said jaw portion of the first handle piece comprises a leveragable jaw head coupled to the first handle piece and wherein said third handle piece is coupled to the leveragable jaw head.

14. The locking tool of claim 1, further comprising a V-edged piece defining tapering edges extending from a wide base to a relatively narrower top and having a center cam, wherein each of the jaw portions further comprises an attachment, and wherein the diagonal locking pin and the axle pin further engage the center cam with the attachments of the first and the second jaw portions engaging a respective tapering edge of the V-edged piece.

15. The locking tool of claim 1, wherein the diagonal locking pin and the third piece are integrally formed.

* * * * *